United States Patent [19]

Price, III

[11] Patent Number: 4,843,526

[45] Date of Patent: Jun. 27, 1989

[54] FLASHLIGHT WITH SWITCH ASSEMBLY

[76] Inventor: George T. Price, III, 2223 E. 37th St., Los Angeles, Calif. 90058

[21] Appl. No.: 107,781

[22] Filed: Oct. 13, 1987

[51] Int. Cl.[4] ..... F21L 15/02

[52] U.S. Cl. ..... 362/187; 362/205; 362/207; 200/60

[58] Field of Search ..... 362/205, 207, 204, 20 C, 362/187, 158; 200/60

[56] References Cited

U.S. PATENT DOCUMENTS

| | | | |
|---|---|---|---|
| D. 263,170 | 2/1982 | Maglica | D26/49 |
| 3,162,376 | 12/1964 | Furuya | 200/60 X |
| 3,798,440 | 3/1974 | Brindley | 362/205 |
| 3,963,886 | 6/1976 | Yen | 200/60 |
| 4,250,446 | 2/1981 | Ponte | 362/205 X |
| 4,286,311 | 8/1981 | Maglica | 362/187 X |
| 4,398,238 | 8/1983 | Nelson | 362/187 |
| 4,527,223 | 7/1985 | Maglica | 362/205 X |
| 4,530,039 | 7/1985 | Shin-shi | 362/207 X |
| 4,577,263 | 3/1986 | Maglica | 362/205 X |
| 4,722,036 | 1/1988 | Hastings | 362/204 X |

FOREIGN PATENT DOCUMENTS

| | | | |
|---|---|---|---|
| 622796 | 5/1949 | United Kingdom | 362/207 |

OTHER PUBLICATIONS

Mini-Maglite Brochure, Pub. Prior to 12/4/86.
Streamlite Brochure, Pub. Prior to 12/4/86.
"Let's Take the Bull Out of Switches", G. T. Price Products Advertisement , 3/85.

*Primary Examiner*—Stephen F. Husar
*Assistant Examiner*—Richard R. Cole
*Attorney, Agent, or Firm*—Freilich, Hornbaker, Rosen & Fernandez

[57] ABSTRACT

An adjustable focus flashlight comprising three units: a head, a replaceable switch unit, and a battery unit. The replaceable switch unit includes a switch assembly having two holes in one end for bulb leads, and a holder near that end for storing a spare bulb. The replaceable switch unit also includes a cylindrical member around the switch assembly, which is externally threaded, at the end near the holes, to engage the internal threads of the head, and adjust the focus. A flexible sleeve fits around the outer surface of the cylindrical member, the sleeve having a circular protrusion formed in the end thereof, to frictionally engage part of the head, and maintain a selected focus adjustment.

9 Claims, 3 Drawing Sheets

FLASHLIGHT WITH SWITCH ASSEMBLY

BACKGROUND

Nelson U.S. Pat. No. 4,398,238 describes an adjustable focus flashlight having a reflector mounted in the head, in which the focus is adjusted by turning the head on the flashlight body, as is well-known in the art. Nelson shows a switch module in the body which holds the bulb. He teaches retaining the focus adjustment with a helical spring disposed partly in the flashlight body and partly within the head. One end of the spring is seated on the outer, or rearward, surface of the reflector, and the other flat end is seated on the switch module. As Nelson points out, the seat on the switch module is flat and relatively slick, so the spring can easily rotate with respect to the module as the head is turned. If this were not so, according to Nelson, the spring might be more effective than desired in retaining the position of the head, and could even prevent a desired focus of the flashlight beam from being accomplished. Alternatively, Nelson points out, if twisting the head were accompanied by twisting of the spring, then the spring would tend to return to its initial position rather than retaining it in the desired position of adjustment. Obviously, then, using the seat on the switch module to support the spring prevents the storage of a spare bulb near the end of the module.

My invention, on the other hand, eliminates the spring, and provides an easily accessible spare bulb near the end of the switch module. Instead of the spring, I provide a replaceable switch unit threadably connected to the head and the battery unit, said unit having an O-ring that frictionally engages part of the head, to retain the focus adjustment.

SUMMARY

This invention relates to an adjustable-focus flashlight consisting of a head, a replaceable switch unit, and a battery unit.

An object of the invention is to provide a flashlight of this type having a readily accessible spare bulb holder, located in a switch assembly, in the switch unit, near the bulb in use, for quick replacement thereof in case of failure.

Another object of the invention is to provide a flashlight of this type with a novel means for adjusting, and retaining, the focus, said means comprising a switch unit having a cylindrical member around the switch assembly, and a flexible sleeve around the outer surface of the cylindrical member, with an O-ring formed in the end thereof, to engage a part of the head threadably attached to the cylindrical member.

The foregoing, and other, objects and advantages will appear from the following drawings and description.

DRAWINGS

DESCRIPTION

Figure 1:
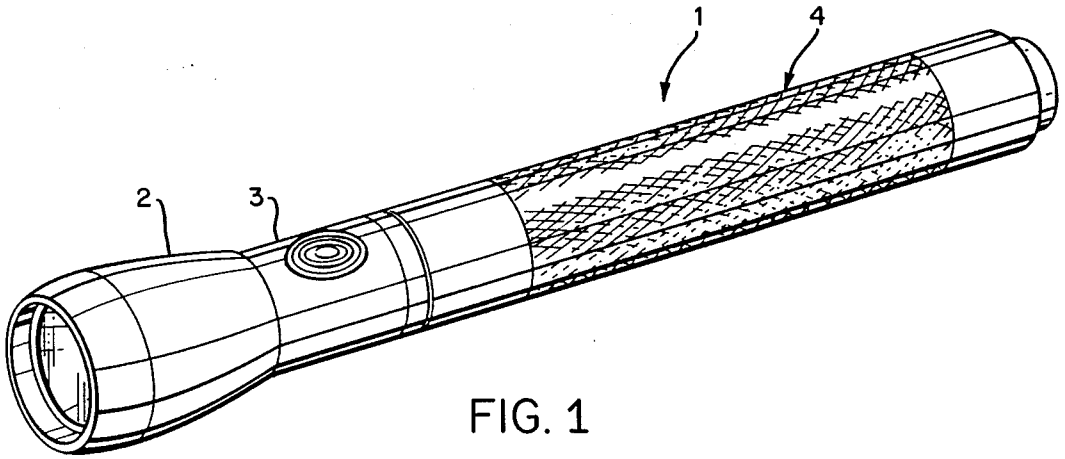
FIG. 1 is a perspective view of a flashlight in accordance with the preferred form of my invention.

Referring to FIG. 1 the flashlight 1 comprises a head 2, a replaceable switch unit 3, and a battery unit 4.

Figure 2:
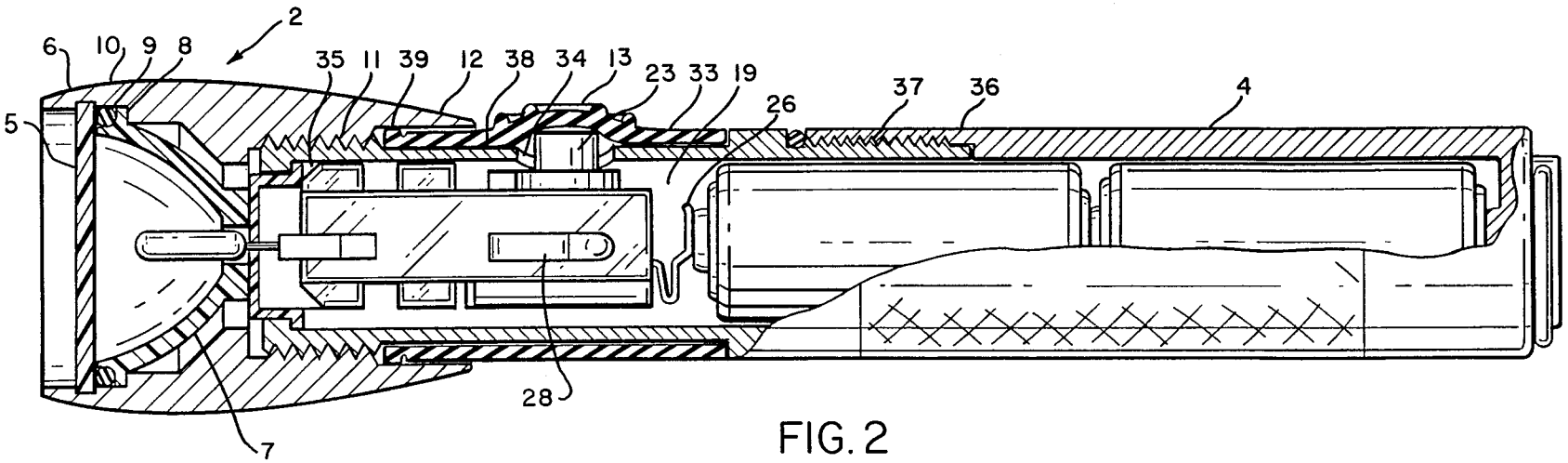
FIG. 2 is a longitudinal cross-sectional view of FIG. 1.

As best shown in FIG. 2, the head 2 includes a lens 5, mounted in a recess 6, in one end of the head, and a reflector 7, having a flange 8, mounted in a recess 9. A resilient ring 10 is located between the lens 5 and the flange 8. The other end of the head has internal threads 11, and an unthreaded portion 12, of slightly larger diameter, extending rearwardly.

Figure 4:
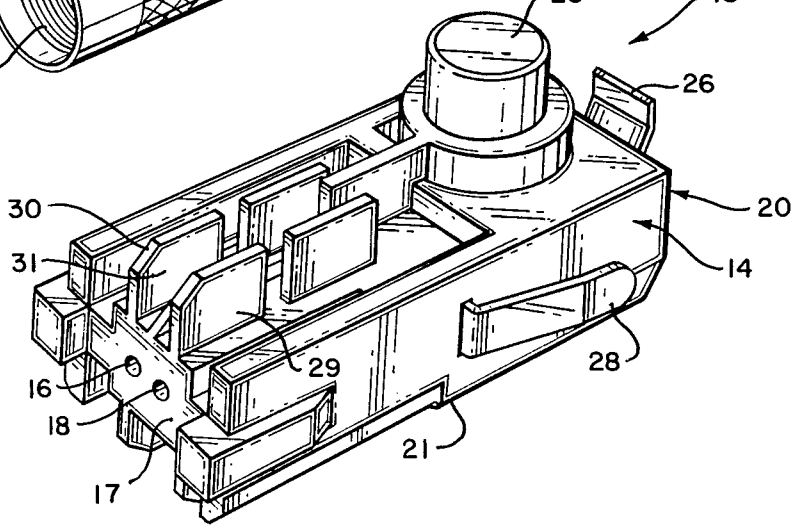
FIG. 4 is an enlarged, perspective view of the switch assembly, showing the means for storing a spare bulb.
Figure 5:
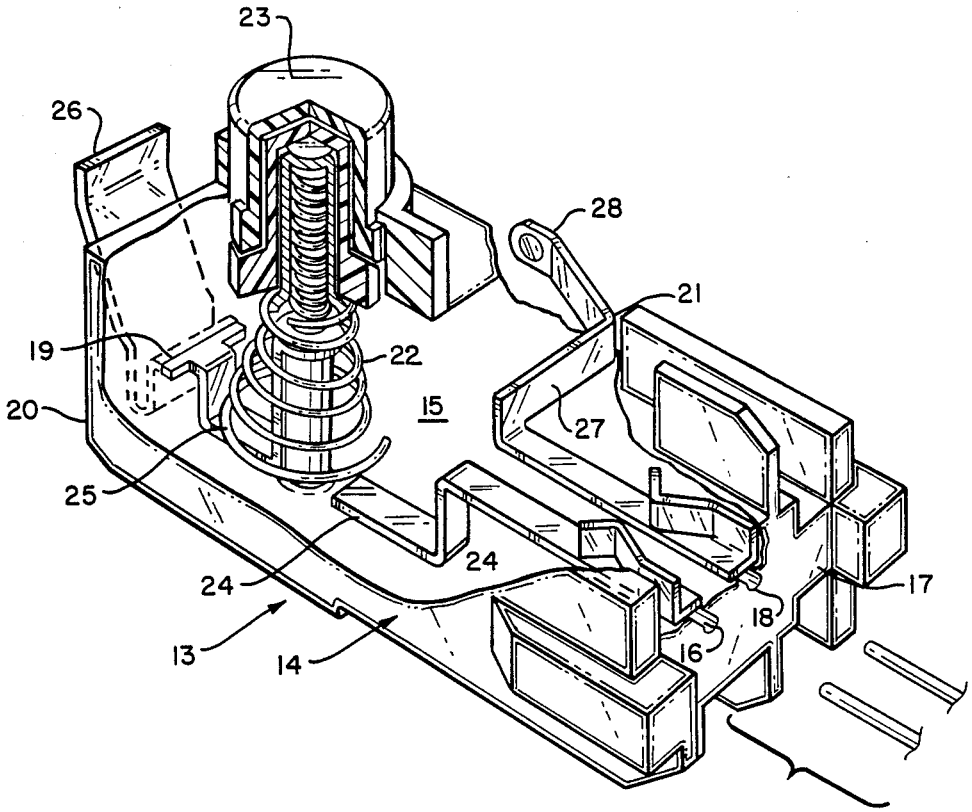
FIG. 5 is another enlarged, perspective view of the switch assembly, partially broken-away.

A switch assembly 13, best shown in FIG. 5, comprises a switch body 14 having a top wall, a bottom wall, two side walls and two ends, with a cavity 15 therein. A first hole 16, for receiving a bulb lead, in the first end 17 of the body 14, communicates with the cavity 15. A second hole 18, for receiving a bulb lead, is also located in first end 17 of the body 14. A first opening 19, located in the second end 20 of the body 14, communicates with the cavity 15, and a second opening 21, in the body 14, communicates with the second hole 18. A spring-biased switch member 22, located in the cavity 15, has an actuating member 23, and a pair of terminals 24, 25. The first terminal 24 extends into the first hole 16, and is crimped at the end to retain the bulb lead. The other terminal 25 extends into the first opening 19. A spring contact 26, adjacent the second end 20 of the body 13, is connected to the second terminal 25. Depressing the actuating member 23 connects the terminals 24, 25, thereby connecting the spring contact 26 with the interior of the hole 16. A conductor 27, located in the second opening 21, and in the second hole 18, is also crimped at one end to retain the bulb lead. A spring contact 28, adjacent the second opening 21, is connected to the conductor 27. As best shown in FIG. 4, a pair of flexible members 29, 30, in an opening 31, in the first end 17, of the body 14, engage the opposite sides of a spare bulb (not shown).

Figure 3:
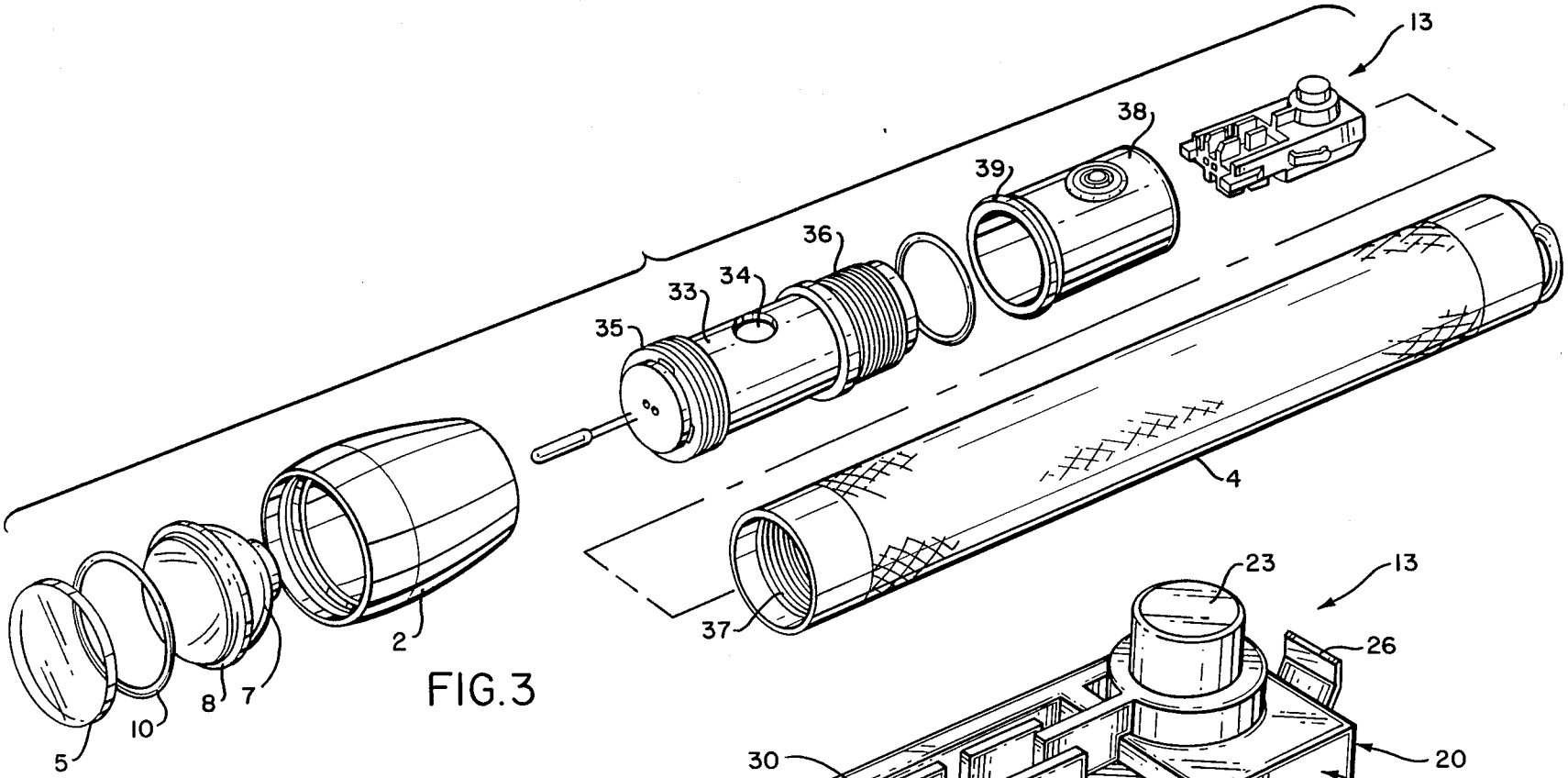
FIG. 3 is an exploded view of FIG. 1.

Referring to FIGS. 2 and 3, the switch assembly 13 is surrounded by a cylindrical member 33, which engages the spring contact 28. The switch assembly 13 is fastened inside the member 33 by glue, or other conventional means. The cylindrical member 33 has an opening 34, for the actuating member 23, and has external threads 35 at one end, to engage the internal threads 11 of the head. The other end of the cylindrical 33 also has external threads 36, to engage the internal threads 37 of the battery unit 4.

A flexible sleeve 38, of rubber, for example, surrounds the outer surface of the cylindrical member 33, and has a circular protrusion 39 at the end. The circular protrusion frictionally engages the unthreaded portion 12 of the head 2, to restrain rotation of the head 12, and maintain the focus adjustment. Therefore, the switch assembly 13, the cylindrical member 33, and the flexible sleeve 38 form an easily replaceable switch unit 3.

While I have described the best mode of carrying out my invention, it will be obvious to those killed in the art that many variations may be made in the exact construction shown without departing from the spirit and scope of the invention.

What is claimed:

1. A flashlight comprising:

a switch body having a top wall, a bottom wall, two side walls and two ends;

a first hole in the first end of the body, for receiving a first bulb lead;

a second hole in the first end of the body, for receiving a second bulb lead;

a first contact on the second end of the body;

a second contact on one of the walls of the body;

a cylindrical member around the top, bottom, and side walls of the body, said member engaging the second contact;

a flexible sleeve around the outer surface of the cylindrical member, said sleeve having a circular protrusion formed in the end thereof;

a head threadably attached to one end of the cylindrical member, with part of the head frictionally engaging the circular protrusion, to maintain a selected focus adjustment; and a battery unit threadably attached to the other end of the cylindrical member.

2. A flashlight as defined in claim 1 further comprising:

means near the first end of the body, for storing a spare bulb.

3. A flashlight as defined in claim 2 wherein the means near the first end of the body, for storing a spare bulb, comprises a pair of flexible members, for engaging opposite sides of the bulb.

4. A flashlight comprising:

a switch body having a top wall, bottom wall, two sides walls and two ends;

a first hole in the first end of the body, for receiving a first bulb lead;

a second hole in the first end of the body, for receiving a second bulb lead;

a first contact on the second end of the body;

a second contact on one of the walls of the body;

means for electrically connecting the interior of the first hole with the first contact, including switch means;

means for electrically connecting the interior of the second hole with the second contact;

a cylindrical member around the top, bottom, and side walls of the body, said member engaging the second contact and having an opening therein for communicating with the switch means;

a flexible sleeve around the outer surface of the cylindrical member, said sleeve having a circular protrusion formed in the end thereof;

a head threadably attached to one end of the cylindrical member, with part of the head frictionally engaging the circular protrusion, to maintain a selected focus adjustment; and a battery unit threadably attached to the other end of the cylindrical member.

5. A flashlight as defined in claim 4 further comprising:

means near the first end of the body, for storing a spare bulb.

6. A flashlight as defined in claim 5 wherein the means near the first end of the body, for storing a spare bulb, comprises a pair of flexible members, for engaging opposite sides of the bulb.

7. A flashlight comprising:

a switch body having a cavity therein, said body having a top wall, bottom wall, two side walls, and two ends;

a first hole, in the first end of the body, for receiving a first bulb lead, said first hole communicating with said cavity;

a second hole, in the first end of the body, for receiving a second bulb lead;

a first opening, in the second end of the body, said first opening communicating with said cavity;

a second opening, in one of the walls of the body, said second opening communicating with said second hole;

a switch, in the cavity, said switch having an actuating member and a pair of terminals, the first terminal extending into the first hole, and the second terminal extending into the first opening;

a first spring contact, adjacent the second end of the body, connected to the second terminal;

means for connecting said first and second terminals, in response to the movement of the actuating member;

a conductor, in the second hole and the second opening;

a second spring contact, adjacent the second opening, connected to the conductor;

a cylindrical member around the top, bottom and side walls of the switch body, said member engaging the second spring contact and having an opening therein, for communicating with the actuating member;

a flexible sleeve around the outer surface of said cylindrical member, said sleeve having a circular protrusion formed at the end thereof; and a head threadably attached to one end of the cylindrical member, with part of the head frictionally engaging the circular protrusion, to maintain a selected focus adjustment; and a battery unit threadably attached to the other end of the cylindrical member.

8. A flashlight as defined in claim 7 further comprising:

means near the first end of the body, for storing a spare bulb.

9. A flashlight as defined in claim 8 wherein the means near the first end of the body, for storing a spare bulb comprises a pair of flexible members, for engaging opposite sides of the bulb.

* * * * *